US007159256B1

(12) United States Patent
Licari

(10) Patent No.: US 7,159,256 B1
(45) Date of Patent: Jan. 9, 2007

(54) MULTIFUNCTIONAL OUTDOOR BLANKET ANCHORS

(76) Inventor: Elizabeth A. Licari, 2850 Quantum Lakes Dr., Boynton Beach, FL (US) 33426

( * ) Notice: Subject to any disclaimer, the term of this patent is extended or adjusted under 35 U.S.C. 154(b) by 0 days.

(21) Appl. No.: 11/236,465

(22) Filed: Sep. 28, 2005

(51) Int. Cl.
*A47B 97/00* (2006.01)
*A47G 9/06* (2006.01)

(52) U.S. Cl. ..... 5/417; 135/118; 248/545; 248/508

(58) Field of Classification Search ..... 248/545, 248/500, 508, 156.7; 52/155; 135/118; 5/417

See application file for complete search history.

(56) References Cited

U.S. PATENT DOCUMENTS

| | | | | |
|---|---|---|---|---|
| 2,840,092 | A | 6/1958 | Hill | |
| 2,939,468 | A * | 6/1960 | Boyce | 248/508 |
| 3,241,202 | A | 3/1966 | Knauft | |
| 4,334,661 | A * | 6/1982 | Pitt | 248/146 |
| 4,914,767 | A * | 4/1990 | Balicki et al. | 5/419 |
| 4,927,118 | A * | 5/1990 | Pierorazio | 248/545 |
| 5,150,485 | A | 9/1992 | Maguire | |
| 5,176,354 | A | 1/1993 | Feigenbaum, Jr. | |
| 5,245,715 | A | 9/1993 | Dinkins | |
| 5,294,083 | A * | 3/1994 | Roth | 248/146 |
| 5,327,922 | A * | 7/1994 | Deroche | 135/118 |
| 5,390,890 | A * | 2/1995 | Ferguson et al. | 248/545 |
| 5,524,309 | A * | 6/1996 | La Barbera | 5/658 |
| 5,713,383 | A * | 2/1998 | Ramirez et al. | 135/118 |
| D392,556 | S | 3/1998 | Mills | |
| 6,631,527 | B1 * | 10/2003 | Hyduk | 5/417 |

* cited by examiner

*Primary Examiner*—Michael Trettel

(57) ABSTRACT

An assembly includes an anchor formed from non-corrosive material that includes an elongated stake section provided with a rectilinear spine traveling along an entire length thereof. The stake section has a pair of monolithically formed shoulders diverging forwardly and away from the spine. The shoulders include rectilinear edges equidistantly spaced from the spine so that the stake section defines an elbow-shaped cross-section. The stake section has a coupling monolithically formed with a top end thereof that has a rigid front face and an open rear face. A clamp section is connected to the coupling that can be pivoted about an axis defined orthogonal to the spine. The clamp section is provided with a cup holder monolithically formed therewith for supporting a beverage at an elevated position above the ground surface. The clamp section further has decorative surface indicia imprinted thereon which are associated with beach paraphernalia.

15 Claims, 4 Drawing Sheets

MULTIFUNCTIONAL OUTDOOR BLANKET ANCHORS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to blanket anchors and, more particularly, to multifunctional outdoor blanket anchors for securely holding a blanket in place during outdoor use.

2. Prior Art

Blankets as typically utilized in outdoor events such as upon a beach are subject to displacement due to wind, manual manipulation, and the like. Devices and assemblies for anchoring beach towels and blankets in beach sand or soft earth is generally known, but for one reason or another suffers from certain disadvantages. One disclosed example shows a multi-part device comprising a stake and an interfittable flat plate wedge in the shape of a heart for grasping the blanket between the bottom of the wedge and the top of the stake. Presumably, the stake is driven into the beach sand by applying a downward pushing or striking force to the flat plate. Nonetheless, because of its multipart construction, this device is vulnerable to being misplaced and rendered inoperable and is expensive to fabricate.

Other solutions for maintaining a blanket or towel for outdoor use relatively fixed on beach sand or soft earth includes affixing various devices directly to the blanket per se. Such an example includes a beach blanket that is provided with triangular-shaped corner pockets adapted to hold a quantity of sand therein. Unfortunately, with sufficiently strong wind the beach blanket can still be disturbed from its original position, and the use of sand requires frequent washing of the blanket. Another similar example shows a beach blanket that has a tube sewn or otherwise contained in the border of the blanket. The tube is fitted with a liquid to provide weight means for maintaining the blanket relatively stationary on the beach sand or a lawn. This is not advantageous, since the tube may rupture on sharp objects often encountered outdoors, which would result in a mess and render the towel unusable.

Accordingly, a need remains for multifunctional outdoor blanket anchors in order to overcome the above-noted shortcomings. The present invention satisfies such a need by providing a blanket anchor assembly that is convenient, easy to use, and reasonably priced. Such a multifunctional outdoor blanket anchor assembly provides the beach attendees and picnickers with an effective means to keep their blankets and/or towels from blowing about. This advantageously eliminates frustration and allows the sunbather or picnicker to relax, thus increasing their comfort and allowing them to enjoy their leisure time. The assembly further eliminates the need to position unsightly items that are also tripping hazards, such as rocks, shoes, sand etc. at the corners of their blankets or towels. The blanket anchor assembly is practical, compact, durable, and easy to transport, light weight, and brightly colored to reduce a loss thereof.

BRIEF SUMMARY OF THE INVENTION

In view of the foregoing background, it is therefore an object of the present invention to provide multifunctional outdoor blanket anchors. These and other objects, features, and advantages of the invention are provided by a decorative assembly for securely holding a blanket in place during outdoor use.

The assembly includes at least one anchor formed from non-corrosive material. Such an anchor includes an elongated and rectilinear stake section provided with a rectilinear spine traveling along an entire longitudinal length of the stake section and defined along a posterior wall thereof. The stake section has a pair of monolithically formed shoulders diverging forwardly and away from the spine. Such shoulders each include rectilinear edges equidistantly spaced from the spine and positioned anterior thereof so that the stake section defines an elbow-shaped cross-section conveniently suitable for submerging the stake below a ground surface and thereby effectively holding the blanket at a substantially stable position during inclement weather conditions.

The stake section may be provided with a tapered bottom end for defining an oblique angle. Such a tapered bottom end advantageously assists the user to penetrate the ground surface when anchoring the blanket thereagainst. The stake section also has a coupling monolithically formed with a top end thereof that has a rigid front face and an open rear face.

A clamp section is directly connected to the coupling such that the clamp section can conveniently be selectively pivoted about a fulcrum axis defined orthogonal to the spine. Such a clamp section is pivotal between horizontal and vertical positions defined by the front and rear faces of the coupling respectively. The clamp section is provided with a cup holder monolithically formed therewith for advantageously supporting a beverage bottle at an elevated position above the ground surface when the clamp section is adapted to the horizontal position. Such a cup holder may be monolithically formed with one of the handles and is vertically registered with a top one of the jaw portions. The clamp section has decorative surface indicia imprinted thereon which are associated with beach paraphernalia.

The clamp section preferably further includes first and second arms including monolithically formed handle and jaw portions pivotally connected to each other respectively. A bottom one of the handles preferably remains stationary while a top one of the handles is adapted between open and closed positions. Each jaw portion has a serrated surface removably engageable with each other in such a manner that the jaw portions become coextensively abutted when adapted to a closed position. A rectilinear pin that has opposed end portions is directly conjoined with the coupling and aligned orthogonal to the longitudinal axis thereof. A resilient spring member is directly nested about the pin and provided with flanged end portions directly abutted against the handle portions such that the jaw portions are conveniently caused to pivot to the closed position after a user releases the handle portions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
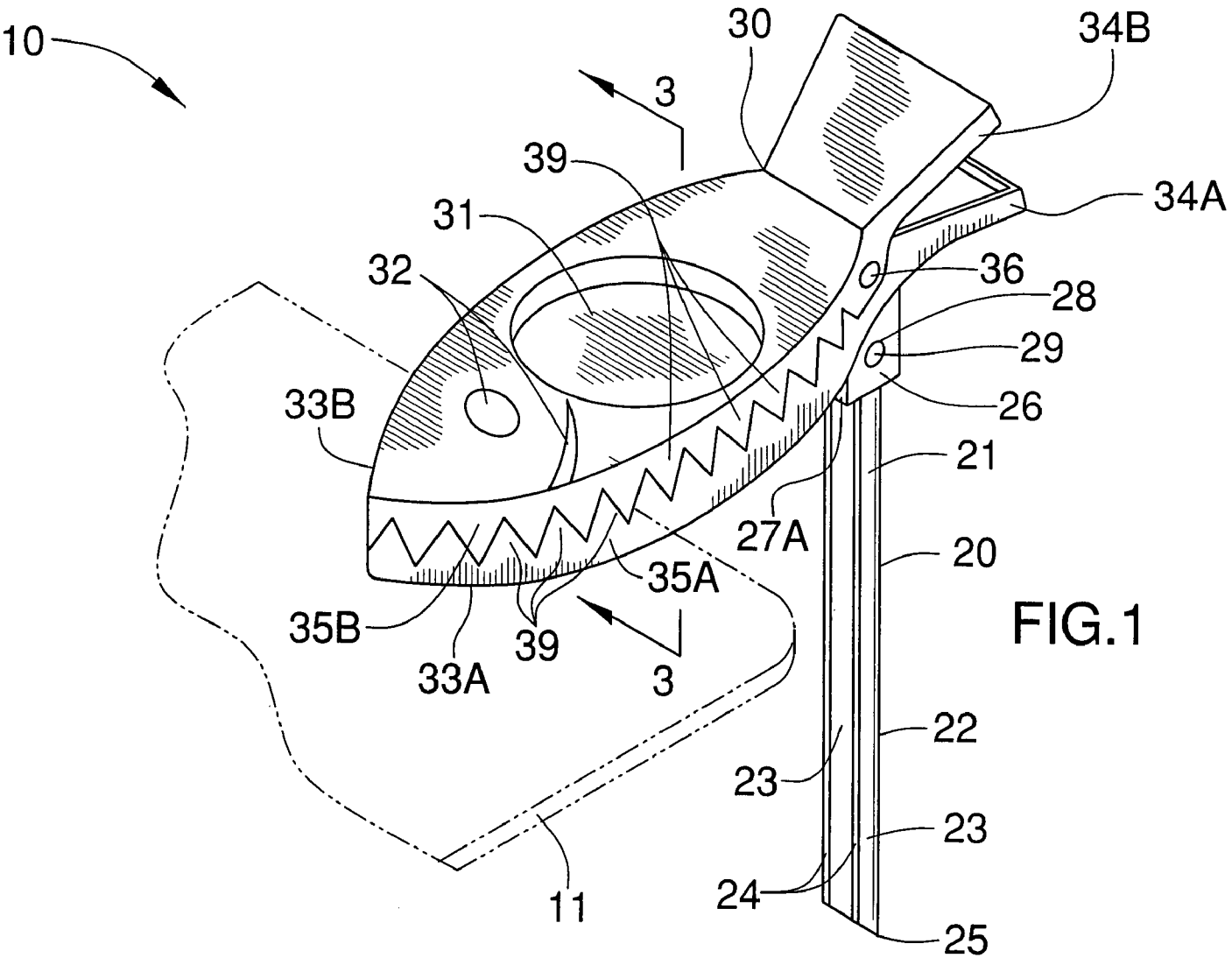
FIG. 1 is a perspective view showing a multifunctional outdoor blanket anchor assembly, in accordance with the present invention.
Figure 2:
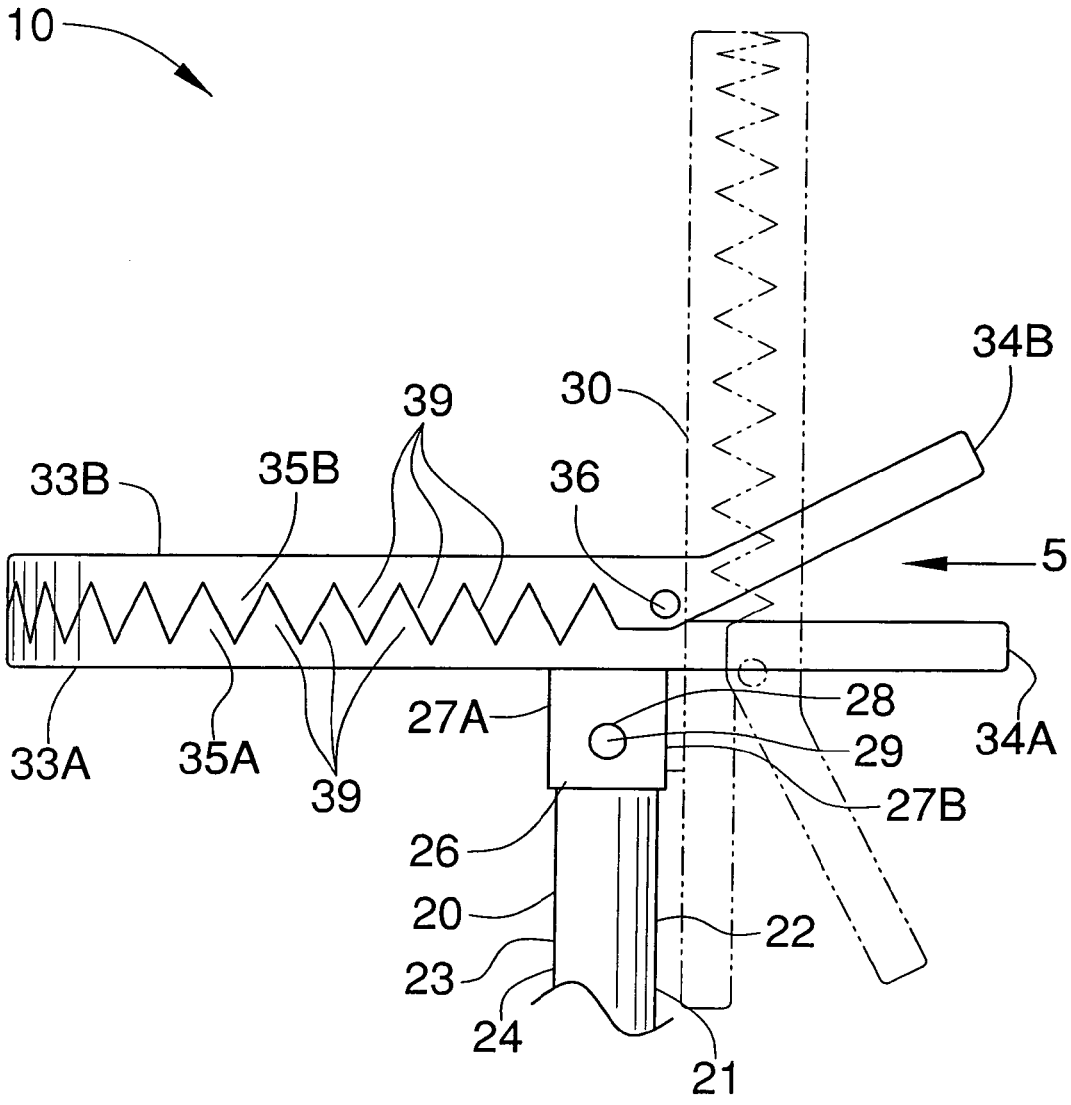
FIG. 2 is an enlarged side-elevational view of the assembly shown FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1–4 by the reference numeral 10 and is intended to provide a multifunctional outdoor blanket anchor assembly. It should be understood that the assembly 10 may be used to anchor many different types of objects and should no be limited in use to only anchoring blankets.

Referring initially to FIG. 1, the assembly 10 includes at least one anchor 20 formed from non-corrosive material, which is important for ensuring that the anchor 20 does not deteriorate when exposed to environmental elements such as water. Such an anchor 20 includes an elongated and rectilinear stake section 21 provided with a rectilinear spine 22 traveling along an entire longitudinal length of the stake section 21 and defined along a posterior wall thereof. The stake section 21 has a pair of monolithically formed shoulders 23 diverging forwardly and away from the spine 22. Such shoulders 23 each include rectilinear edges 24 equidistantly spaced from the spine 22 and positioned anterior thereof so that the stake section 21 defines an elbow-shaped cross-section that is essential and conveniently suitable for submerging the stake 21 below a ground surface and thereby effectively holding the blanket 11 at a substantially stable position during inclement weather conditions.

Referring to FIGS. 1 through 4, the stake section 21 is provided with a tapered bottom end 25 for defining an oblique angle, as is best shown in FIG. 1. Such a tapered bottom end 25 is critical and advantageous for assisting the user to penetrate the ground surface more easily when anchoring the blanket 11 thereagainst. The stake section 21 also has a coupling 26 monolithically formed with a top end thereof that has a rigid front face 27A and an open rear face 27B.

Still referring to FIGS. 1 through 4, a clamp section 30 is directly connected, with no intervening elements, to the coupling 26 such that the clamp section 30 can conveniently be selectively pivoted about a fulcrum axis defined orthogonal to the spine 22. Such a clamp section 30 is pivotal between horizontal and vertical positions defined by the front 27A and rear 27B faces of the coupling 26 respectively. The clamp section 30 advantageously prevents items held therein from being blown about in the wind and may also be used to hold valuables, like keys and wallets, to prevent those items from being misplaced. In addition, the clamp section 30 eliminates the need to use unsightly and cumbersome items such as coolers, rocks, shoes, bag, etc. commonly used to hold down blankets and towels. This, in turn, removes a possible tripping hazard that could otherwise lead to serious injury.

Figure 3:
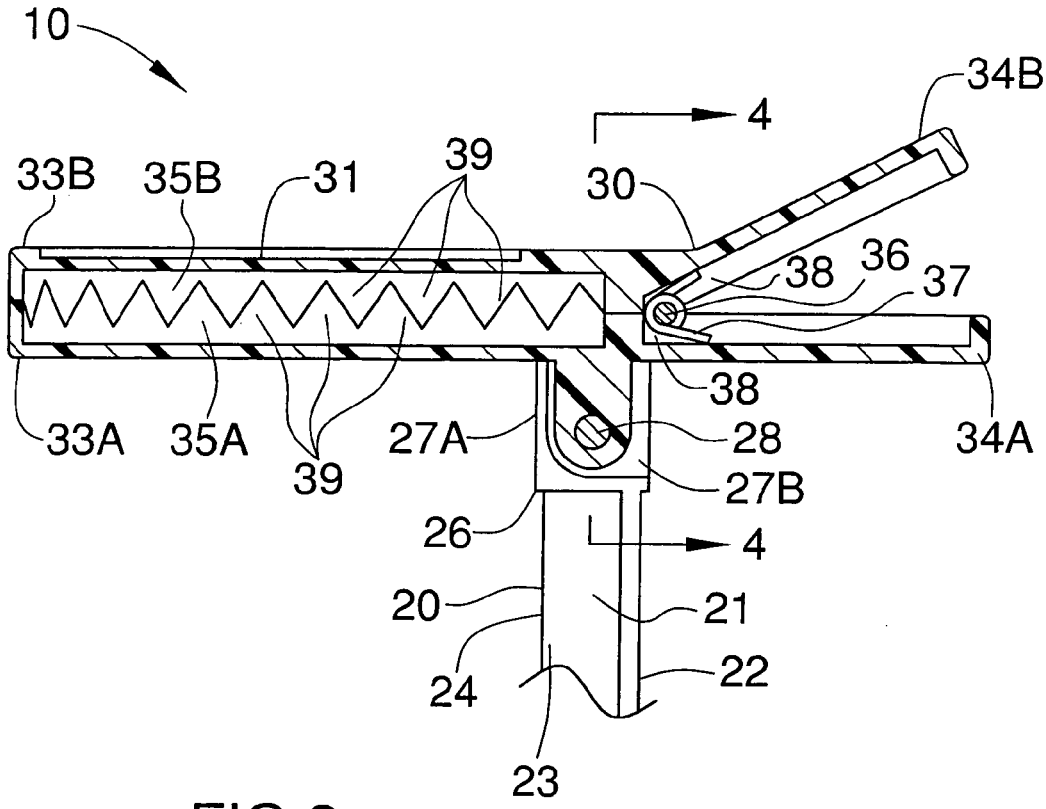
FIG. 3 is a cross-sectional view of the assembly shown in FIG. 1, taken along line 3—3.
Figure 5:
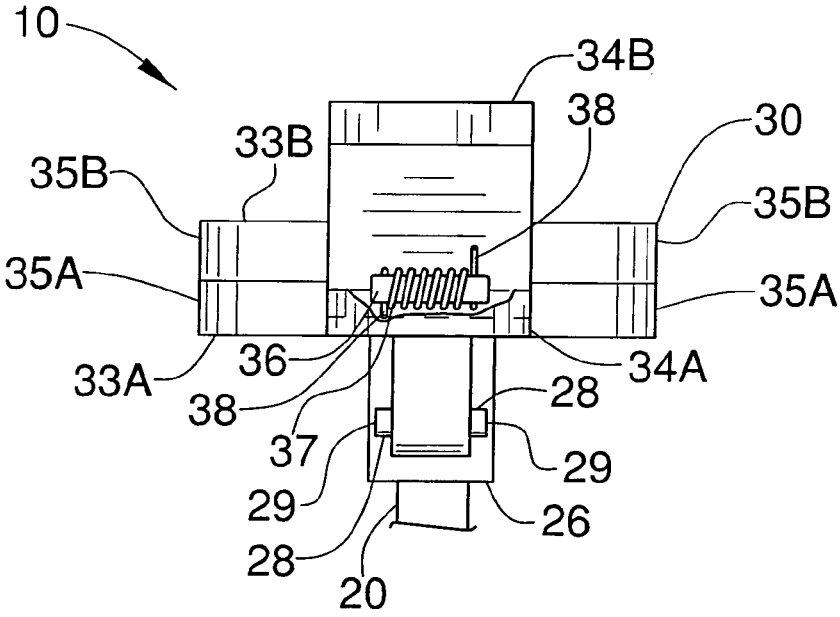
FIG. 5 is an enlarged rear-elevational view of the assembly shown in FIG. 1.
Figure 4:
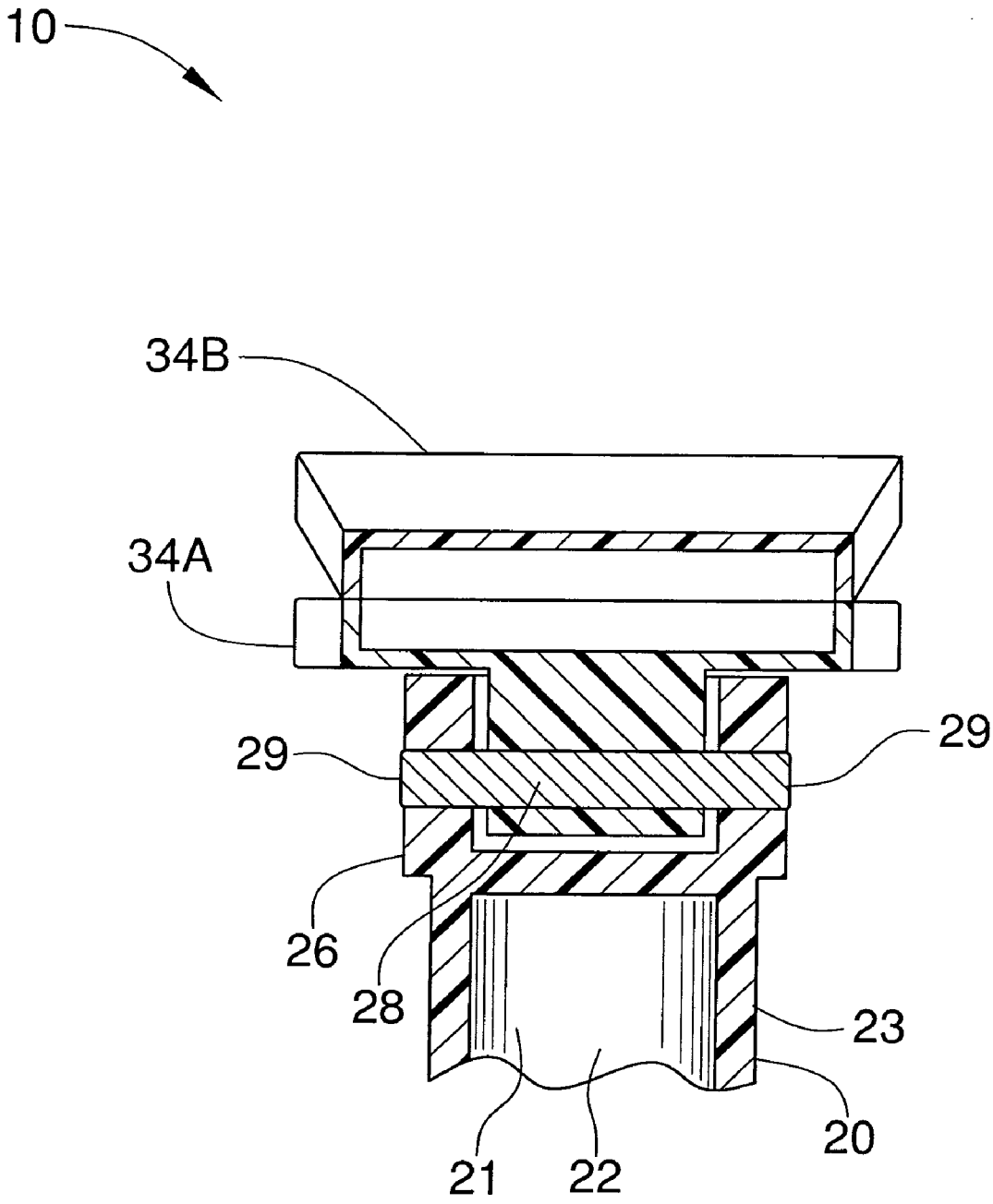
FIG. 4 is a cross-sectional view of the assembly shown in FIG. 3, taken along line 4—4.

Referring to FIGS. 1 and 3, the clamp section 30 is provided with a cup holder 31 monolithically formed therewith, which is vital and advantageous for supporting a beverage bottle (not shown) at an elevated position above the ground surface when the clamp section 30 is adapted to the horizontal position. Such a cup holder 31 is monolithically formed with one of the handles 34B (described herein below) and is vertically registered with a top one 35B of the jaw portions 35 (described herein below). The clamp section 30 has decorative surface indicia 32 imprinted thereon which are associated with beach paraphernalia. Of course, such surface indicia 32 may be associated with other themes other than beach paraphernalia, as is obvious to a person of ordinary skill in the art.

Referring to FIGS. 1 through 4, the clamp section 30 further includes first 33A and second 33B arms including monolithically formed handle 34A, 34B and jaw 35A, 35B portions pivotally connected, with no intervening elements, to each other respectively. A bottom one 34A of the handles 34 remains stationary while a top one 34B of the handles 34 is adapted between open and closed positions. Each jaw portion 35 has a serrated surface removably engageable with each other in such a manner that the jaw portions 35 become coextensively abutted when adapted to a closed position. Such a serrated surface of the jaw portions 35 provides sufficient frictional resistance to advantageously prevent an object held therebetween from being dislodged.

Still referring to FIGS. 1 through 4, a rectilinear pin 36 that has opposed end portions is directly conjoined, with no intervening elements, with the coupling 26 and aligned orthogonal to the longitudinal axis thereof. A resilient spring member 37 is directly nested, with no intervening elements, about the pin 36 and provided with flanged end portions 38 directly abutted, with no intervening elements, against the handle portions 34 such that the jaw portions 35 are conveniently caused to pivot to the closed position after a user releases the handle portions 34. This feature ensures that the jaw portions 35 securely grasp the object placed therebetween, which is crucial for maintaining such an object at a substantially stable position during operating conditions.

During employment of the assembly 10, a user positions their towel or blanket in the desired position. Next, the stake section 21 of one anchor 20 is inserted into the ground surface and the clamp section 30 thereof is affixed to one corner of the blanket, or any other suitable location thereon. The user completes the anchoring procedure by repeating the above mentioned steps with at least three more assemblies 10 at each corner of the blanket/towel. For blankets with abnormally large surface areas additional assemblies 10 may, of course, be attached along the edges thereof, in addition to those attached at the corners.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A decorative assembly for securely holding a blanket in place during outdoor use, said assembly comprising:

at least one anchor comprising an elongated and rectilinear stake section provided with a rectilinear spine traveling along an entire longitudinal length of said stake section and defined along a posterior wall thereof, said stake section having a pair of monolithically formed shoulders diverging forwardly and away from said spine, said shoulders each including rectilinear edges equidistantly spaced from said spine and positioned anterior thereof so that said stake section defines an elbow-shaped cross-section suitable for submerging the blanket below a ground surface and thereby holding the blanket at a substantially stable position during inclement weather conditions, said stake section having a coupling monolithically formed with a top end thereof, said coupling having a rigid front face and an open rear face, and a clamp section directly connected to said coupling such that said clamp section can be selectively pivoted about a fulcrum axis defined orthogonal to said spine, said clamp section being pivotal between horizontal and vertical positions defined by said front and rear faces of said coupling respectively;

wherein said clamp section is provided with a cup holder monolithically formed therewith for supporting a beverage bottle at an elevated position above the ground surface when said clamp section is adapted to the horizontal position.

2. The assembly of claim 1, wherein said clamp section comprises:

first and second arms including monolithically formed handle and jaw portions pivotally connected to each other respectively, each said jaw portions having a serrated surface removably engageable with each other in such a manner that said jaw portions become coextensively abutted when adapted to a closed position;

a rectilinear pin having opposed end portions directly conjoined with said coupling and aligned orthogonal to the longitudinal axis thereof; and a resilient spring member directly nested about said pin and provided with flanged end portions directly abutted against said handle portions such that said jaw portions are caused to pivot to the closed position after a user releases said handle portions.

3. The assembly of claim 2, wherein said cup holder is monolithically formed with one said handles and is vertically registered with a top one of said jaw portions.

4. The assembly of claim 2, wherein a bottom one of said handles remains stationary while a top one of said handles is adapted between open and closed positions.

5. The assembly of claim 1, wherein said stake section is provided with a tapered bottom end for defining an oblique angle, said tapered bottom end assisting the user to penetrate the ground surface when anchoring the blanket thereagainst.

6. A decorative assembly for securely holding a blanket in place during outdoor use, said assembly comprising:

at least one anchor comprising an elongated and rectilinear stake section provided with a rectilinear spine traveling along an entire longitudinal length of said stake section and defined along a posterior wall thereof, said stake section having a pair of monolithically formed shoulders diverging forwardly and away from said spine, said shoulders each including rectilinear edges equidistantly spaced from said spine and positioned anterior thereof so that said stake section defines an elbow-shaped cross-section suitable for submerging the blanket below a ground surface and thereby holding the blanket at a substantially stable position during inclement weather conditions, said stake section having a coupling monolithically formed with a top end thereof, said coupling having a rigid front face and an open rear face, and a clamp section directly connected to said coupling such that said clamp section can be selectively pivoted about a fulcrum axis defined orthogonal to said spine, said clamp section being pivotal between horizontal and vertical positions defined by said front and rear faces of said coupling respectively;

wherein said clamp section is provided with a cup holder monolithically formed therewith for supporting a beverage bottle at an elevated position above the ground surface when said clamp section is adapted to the horizontal position;

wherein said clamp section has decorative surface indicia imprinted thereon which is associated with beach paraphernalia.

7. The assembly of claim 6, wherein said clamp section comprises:

first and second arms including monolithically formed handle and jaw portions pivotally connected to each other respectively, each said jaw portions having a serrated surface removably engageable with each other in such a manner that said jaw portions become coextensively abutted when adapted to a closed position;

a rectilinear pin having opposed end portions directly conjoined with said coupling and aligned orthogonal to the longitudinal axis thereof; and a resilient spring member directly nested about said pin and provided with flanged end portions directly abutted against said handle portions such that said jaw portions are caused to pivot to the closed position after a user releases said handle portions.

8. The assembly of claim 7, wherein said cup holder is monolithically formed with one said handles and is vertically registered with a top one of said jaw portions.

9. The assembly of claim 7, wherein a bottom one of said handles remains stationary while a top one of said handles is adapted between open and closed positions.

10. The assembly of claim 6, wherein said stake section is provided with a tapered bottom end for defining an oblique angle, said tapered bottom end assisting the user to penetrate the ground surface when anchoring the blanket thereagainst.

11. A decorative assembly for securely holding a blanket in place during outdoor use, said assembly comprising:

at least one anchor formed from non-corrosive material comprising an elongated and rectilinear stake section provided with a rectilinear spine traveling along an entire longitudinal length of said stake section and defined along a posterior wall thereof, said stake section having a pair of monolithically formed shoulders diverging forwardly and away from said spine, said shoulders each including rectilinear edges equidistantly spaced from said spine and positioned anterior thereof so that said stake section defines an elbow-shaped cross-section suitable for submerging the blanket below a ground surface and thereby holding the blanket at a substantially stable position during inclement weather conditions, said stake section having a coupling monolithically formed with a top end thereof, said coupling having a rigid front face and an open rear face, and a clamp section directly connected to said coupling such that said clamp section can be selectively pivoted about a fulcrum axis defined orthogonal to said spine, said clamp section being pivotal between horizontal and vertical positions defined by said front and rear faces of said coupling respectively;

wherein said clamp section is provided with a cup holder monolithically formed therewith for supporting a beverage bottle at an elevated position above the ground surface when said clamp section is adapted to the horizontal position;

wherein said clamp section has decorative surface indicia imprinted thereon which is associated with beach paraphernalia.

12. The assembly of claim 11, wherein said clamp section comprises:

first and second arms including monolithically formed handle and jaw portions pivotally connected to each other respectively, each said jaw portions having a serrated surface removably engageable with each other in such a manner that said jaw portions become coextensively abutted when adapted to a closed position;

a rectilinear pin having opposed end portions directly conjoined with said coupling and aligned orthogonal to the longitudinal axis thereof; and a resilient spring member directly nested about said pin and provided with flanged end portions directly abutted against said handle portions such that said jaw portions are caused to pivot to the closed position after a user releases said handle portions.

13. The assembly of claim 12, wherein said cup holder is monolithically formed with one said handles and is vertically registered with a top one of said jaw portions.

14. The assembly of claim 12, wherein a bottom one of said handles remains stationary while a top one of said handles is adapted between open and closed positions.

15. The assembly of claim 11, wherein said stake section is provided with a tapered bottom end for defining an oblique angle, said tapered bottom end assisting the user to penetrate the ground surface when anchoring the blanket thereagainst.

* * * * *